US007938489B2

(12) United States Patent
Nazari

(10) Patent No.: US 7,938,489 B2
(45) Date of Patent: May 10, 2011

(54) SWIVEL AND RECLINING CHAIR

(76) Inventor: Joseph Nazari, Glendale, CA (US)

( * ) Notice: Subject to any disclaimer, the term of this patent is extended or adjusted under 35 U.S.C. 154(b) by 0 days.

(21) Appl. No.: 12/424,476

(22) Filed: Apr. 15, 2009

(65) Prior Publication Data

US 2010/0264711 A1 Oct. 21, 2010

(51) Int. Cl.
*A47C 1/02* (2006.01)
*A47C 3/02* (2006.01)

(52) U.S. Cl. ..... 297/314; 297/258.1

(58) Field of Classification Search ..... 297/314, 297/258.1
See application file for complete search history.

(56) References Cited

U.S. PATENT DOCUMENTS 30,706 A * 11/1860 Van Vleck ..... 297/314
2,258,640 A 10/1941 Beckette
2,719,571 A * 10/1955 Taylor ..... 297/314 X
2,920,685 A * 1/1960 Trebilcock ..... 297/314
4,598,946 A * 7/1986 Cone ..... 297/258.1
4,659,053 A * 4/1987 Holley et al. ..... 248/663
4,971,392 A 11/1990 Young
4,974,904 A * 12/1990 Phillips et al. ..... 297/258.1
5,590,930 A * 1/1997 Glockl ..... 297/313
5,728,049 A * 3/1998 Alberts ..... 297/314 X
5,887,944 A 3/1999 Boost
6,273,389 B1 * 8/2001 Carlgren ..... 248/371
7,083,234 B2 * 8/2006 Dowty et al. ..... 297/314
2002/0043846 A1 * 4/2002 Brauning ..... 297/314
2005/0173952 A1 * 8/2005 Van Der Laan ..... 297/314 X

FOREIGN PATENT DOCUMENTS

DE 1 099 142 B1 2/1961

OTHER PUBLICATIONS

International Search Report dated Jun. 16, 2010 for International Application PCT/US2010/031303, 2 pages.

* cited by examiner

*Primary Examiner* — Rodney B White
(74) *Attorney, Agent, or Firm* — Christie, Parker & Hale, LLP

(57) ABSTRACT

A swivel and reclining chair has a base support, a base bowl mounted on the base support, and a seating bowl slidably disposed in and over the base bowl. A plurality of friction reduction features are disposed on the inside surface of the base bowl. The outer surface of the seating bowl is spherical in shape and rests on the friction reduction features. The seating bowl is larger in area than the base bowl, and can freely slide in two dimensions as well as rotate in a spherical surface. Optionally, a guard ring is disposed outside of the base bowl and is attached to the base bowl at their rims.

18 Claims, 2 Drawing Sheets

SWIVEL AND RECLINING CHAIR

BACKGROUND OF THE INVENTION

1. Field of the Invention

This invention relates to a chair, and in particular, it relates to a swivel and reclining chair.

2. Description of the Related Art

Swivel chairs of various designs have been available. Typically, a swivel chair includes a base and a seating piece rotatably attached to the base so the seating piece can rotate around a vertical axis of the base. Reclining chairs of various designs are also available, but they typically involve relatively complex mechanical designs.

SUMMARY OF THE INVENTION

An object of the present invention is to provide a swivel and reclining chair that has a simple structure.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a chair which includes: a base structure including a base bowl; one or more friction reduction features disposed on an inside surface of the base bowl; and a seating bowl having a spherical outside surface, the seating bowl being slidably disposed in and over the base bowl, the spherical outside surface of the seating bowl being in contact with the friction reduction features, wherein the seating bowl is larger in area than the base bowl.

It is to be understood that both the foregoing general description and the following detailed description are exemplary and explanatory and are intended to provide further explanation of the invention as claimed.

BRIEF DESCRIPTION OF THE DRAWINGS

FIG. 1*a* shows the chair in a state where the seating bowl is level. FIG. 1*b* shows the chair in a state where the seating bowl is reclined.

DETAILED DESCRIPTION OF THE PREFERRED EMBODIMENTS

Figure 1A:
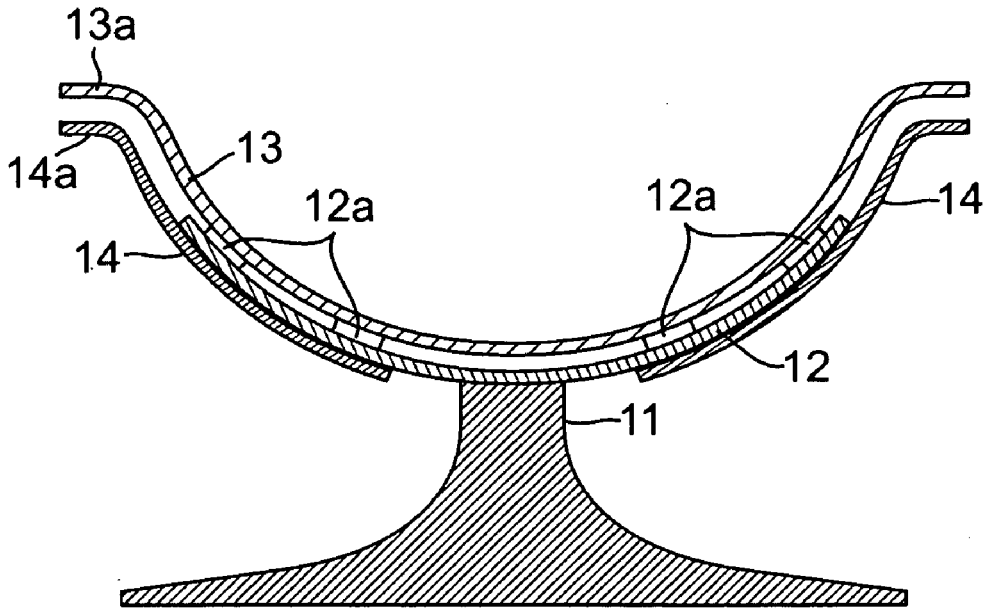
FIGS. 1*a* and 1*b* are schematic cross-sectional views of a swivel and relining chair according to an embodiment of the present invention.
Figure 1B:
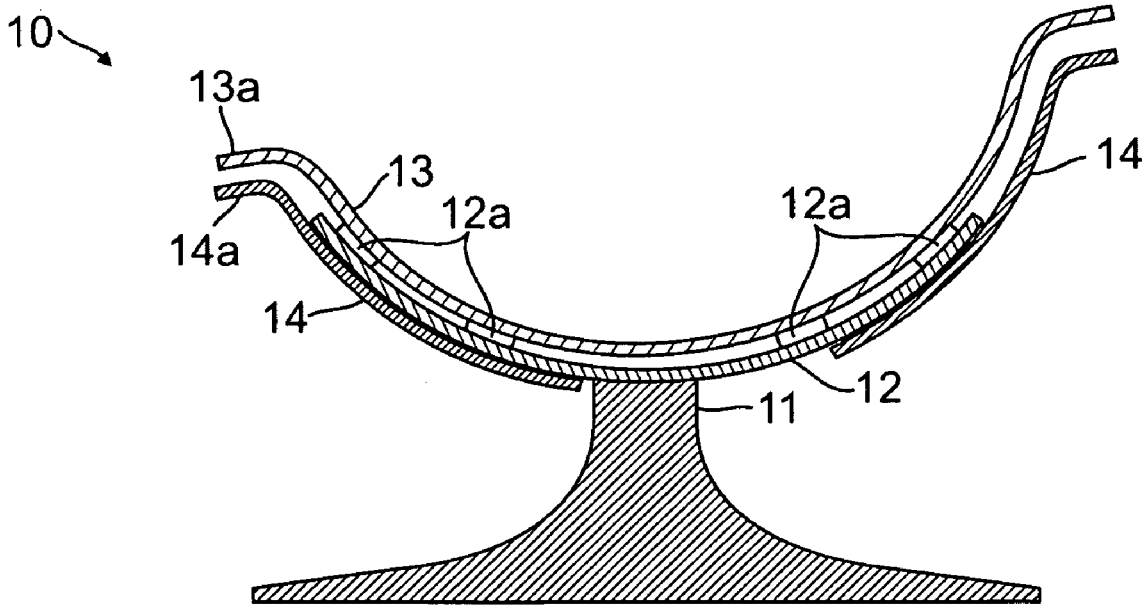
Figure 2:
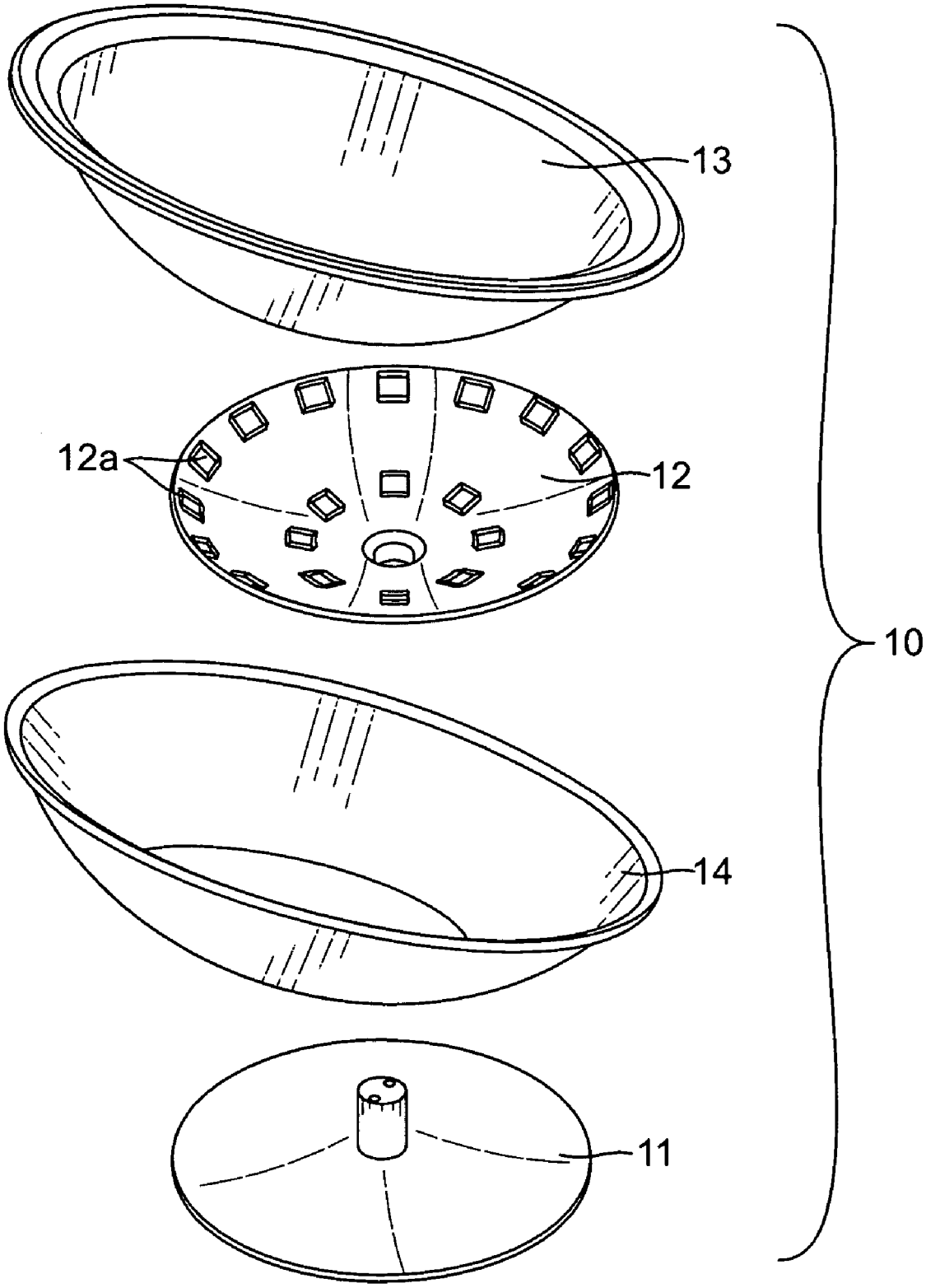
FIG. 2 is an exploded perspective view of the chair of FIGS. 1*a* and 1*b*.

FIGS. 1*a*-2 illustrate a swivel and reclining chair 10 according to an embodiment of the present invention. FIGS. 1*a* and 1*b* are schematic cross-sectional views of the chair; FIG. 1*a* shows the chair in a state where the seating bowl is level, while FIG. 1*b* shows the chair in a state where the seating bowl is reclined. In these schematic views, the gaps between the various components are exaggerated. FIG. 2 is an exploded perspective view.

As shown in FIGS. 1*a*-2, the chair 10 includes a base support 11 to be placed on the floor, a base bowl 12 mounted on the base support 11, a plurality of friction reducing features 12*a* disposed on an inside surface of the base bowl 12, and a seating bowl 13 placed in and over the base bowl 12 in contact with the friction reducing features 12*a* for seating a user. Cushions (not shown) may be placed inside the seating bowl.

In a preferred embodiment, the base bowl 12 is fixedly mounted on the base support 11, but the base bowl may also be mounted so that it can rotate around an axis of the base support. The base bowl 12 and the base support 11 may also be formed as one piece which may be referred to as the base structure.

The outer (convex) surface of the seating bowl 13 has a spherical shape. In a preferred embodiment, the inside (concave) surface of the base bowl 12 also has a spherical shape, and the friction reduction features 12*a* are small flat pieces mounted on the inside surface of the base bowl. The inside surface of the base bowl 12 may have indentations for mounting the small flat pieces of friction reduction features 12*a*. The area of the seating bowl 13 is larger than the area of the base bowl 12 so that the seating bowl 13 can slide relative to the base bowl 12 within a certain range. The friction reduction features 12*a* help the seating bowl 13 slide smoothly relative to the base bowl 12. It is important that the top ends of the friction reduction features 12*a* are located on an imaginary spherical surface having the same curvature as the outer surface of the seating bowl 13 so that the seating bowl can rest on the top ends of the friction reduction features 12*a* and remain resting on them when the seating bowl slides relative to the base bowl 12. The shape of the base bowl 12 and the shape of the friction reduction features 12*a* are not important so long as the top ends of the friction reduction features are located as described above.

FIG. 1*b* shows the seating bowl 13 slid to a tilted (reclined) position. It should be noted that due to the spherical shape of the seating bowl 13, the seating bowl can freely slide in two dimensions as well as rotate in the spherical surface defined by the top ends of the friction reduction features 12*a*.

FIG. 2 shows the friction reduction features 12*a* as being multiple small flat pieces. Alternatively, the friction reduction features 12*a* may be in the form of one or more circular stripes mounted on the inside surface of the base bowl 12, preferably parallel to its rim. The friction reduction features 12*a* may be either separate pieces mounted on the inside surface of the base bowl 12, or they may be protruding features formed integrally with the base bowl 12. Alternatively, the friction reduction features 12*a* may be ball bearings or other types of friction reduction devices.

In the embodiment illustrated and described above, the seating bowl 13 has a spherical outer surface and rests on friction reduction features 12*a* formed on the inside surface of the base bowl 12. In an alternative embodiment, the inside surface of the base bowl 12 has a spherical shape and friction reduction features are mounted on the outside surface of the seating bowl 13. In this alternative embodiment, the shape of the seating bowl 13 is not important so long as the lower ends of the friction reduction features are disposed on an imaginary spherical surface having the same curvature as the inside surface of the base bowl 12. This alternative embodiment is less preferred because more friction reduction features will be needed to be distributed over the outside surface of the seating bowl 13 which is larger than the surface area of the base bowl 12.

In a preferred embodiment, the seating bowl 13 is made of wood, fiberglass or other suitable materials; the base support 11 and the base bowl 12 are made of metal, such as cast iron or cast aluminum, or other suitable material; the friction reduction features 12*a* are made of plastic (e.g. Nylon) or other suitable material. In a preferred embodiment, the seating bowl 13 has a diameter at its rim of about 36 inches.

Optionally, a guard ring 14 is attached to the seating bowl 13 at their respective rims and disposed outside of the base bowl 12, so that the base bowl 12 is sandwiched between the seating bowl 13 and the guard ring 14. The attachment of the seating bowl 13 and the guard ring 14 may be achieved by any suitable means, such as clamps, screws, snap fitting, etc. The guard ring 14 may or may not contact the base bowl 12. The guard ring 14 has the shape of a truncated spherical surface with a hole 14*b* in the middle from which the base support 11 protrudes. Preferably, the size of the hole 14*b* of the guard ring 14 is such that the hole clears the stem of the base support 11 when the seating bowl 13 is slid to its maximum tilt position, as illustrated in FIG. 1*b*.

In a preferred embodiment, the rim of the seating bowl 13 has a lip 13*a* curved outwardly to provide a more comfortable seat for the user. The rim of the guard ring 14 may also have a similarly shaped lip 14*a*, and the seating bowl 13 and the guard ring 14 may be attached to each other in the lip areas.

One function of the optional guard ring 14 is to cover a gap between the seating bowl 13 and the base bowl 12 at the rim of the base bowl 12. Due to the location of such a gap, a user's finger may be caught or pinched in the gap, especially when the seating bowl 13 is slid all the way to the maximum tilt position. Another function of the guard ring 14 is to prevent the seating bowl 13 from being disengaged from the base bowl 12. A disadvantage of the guard ring 14 is that it does not allow the chair to be easily disassembled (by separating the seating bowl 13 and the base bowl 12) for shipping convenience.

In lieu of the guard ring 14, other means may be optionally used to prevent the user's finger from being caught or pinched in the gap. For example (not shown), a brush strap or other soft material may be mounted all around the rim of the base bowl 12, where the brush or the soft material points upwards and fills the gap to prevent a user's finger from accidentally entering into the gap. Using this structure, the base bowl 12 and the seating bowl 13 of the chair can be separated so the chair can be shipped in two different pieces.

It will be apparent to those skilled in the art that various modification and variations can be made in the swivel and relining chair of the present invention without departing from the spirit or scope of the invention. Thus, it is intended that the present invention cover modifications and variations that come within the scope of the appended claims and their equivalents.

What is claimed is:

1. A chair comprising:

a base structure including a base bowl;

one or more friction reduction features disposed on an inside surface of the base bowl; and a seating bowl having a spherical outside surface, the seating bowl being slidably disposed in and over the base bowl, the spherical outside surface of the seating bowl being in contact with the friction reduction features, wherein the seating bowl is larger in area than the base bowl and wherein the friction reduction features include a plurality of flat plastic pieces mounted on the inside surface of the base bowl.

2. The chair of claim 1, wherein the base structure includes a base support, wherein the base bowl is mounted on the base support.

3. The chair of claim 2, further comprising a guard ring having a guard ring rim, and the seating bowl having a seating bowl rim, the guard ring and the seating bowl being attached at the guard ring rim and the seating bowl rim, the guard ring being disposed outside of the base bowl and having a hole from which the base support protrudes.

4. The chair of claim 3, wherein the guard ring has a truncated spherical shape.

5. The chair of claim 1, wherein a rim of the seating bowl has a lip curved outwardly.

6. The chair of claim 1, wherein the seating bowl is made of wood or fiberglass, the base bowl is made of metal, and the friction reduction features are made of plastic.

7. A chair comprising:

a base structure including a base bowl;

one or more friction reduction features disposed on an inside surface of the base bowl; and a seating bowl having a spherical outside surface, the seating bowl being slidably disposed in and over the base bowl, the spherical outside surface of the seating bowl being in contact with the friction reduction features, wherein the seating bowl is larger in area than the base bowl and wherein the friction reduction features include one or more circular stripes of plastic material mounted on the inside surface of the base bowl parallel to a rim of the base bowl.

8. The chair of claim 7, wherein the base structure includes a base support, wherein the base bowl is mounted on the base support.

9. The chair of claim 8, wherein a rim of the seating bowl has a lip curved outwardly.

10. The chair of claim 8, wherein the seating bowl is made of wood or fiberglass, the base bowl are made of metal, and the friction reduction features are made of plastic.

11. The chair of claim 8, further comprising a guard ring having a guard ring rim, and the seating bowl having a seating bowl rim, the guard ring and the seating bowl being attached at the guard ring rim and the seating bowl rim, the guard ring being disposed outside of the base bowl and having a hole from which the base support protrudes.

12. The chair of claim 11, wherein the guard ring has a truncated spherical shape.

13. The chair of claim 7, wherein a rim of the seating bowl has a lip curved outwardly.

14. The chair of claim 7, wherein the seating bowl is made of wood or fiberglass, the base bowl are made of metal, and the friction reduction features are made of plastic.

15. A chair comprising:

a base structure including a base bowl;

one or more friction reduction features disposed on an inside surface of the base bowl; and a seating bowl having a spherical outside surface, the seating bowl being slidably disposed in and over the base bowl, the spherical outside surface of the seating bowl being in contact with the friction reduction features, wherein the seating bowl is larger in area than the base bowl, and further comprising a strap of soft material mounted around a rim of the base bowl between the base bowl and the seating bowl.

16. The chair of claim 15, wherein the base structure includes a base support, wherein the base bowl is mounted on the base support.

17. The chair of claim 16, further comprising a guard ring having a guard ring rim, and the seating bowl having a seating bowl rim, the guard ring and the seating bowl being attached at the guard ring rim and the seating bowl rim, the guard ring being disposed outside of the base bowl and having a hole from which the base support protrudes.

18. The chair of claim 17, wherein the guard ring has a truncated spherical shape.

* * * * *

UNITED STATES PATENT AND TRADEMARK OFFICE

CERTIFICATE OF CORRECTION

PATENT NO. : 7,938,489 B2
APPLICATION NO. : 12/424476
DATED : May 10, 2011
INVENTOR(S) : Joseph Nazari It is certified that error appears in the above-identified patent and that said Letters Patent is hereby corrected as shown below:

In the Claims

Column 4, Claim 10, line 28 Delete "are" Insert -- is --

Column 4, Claim 14, line 41 Delete "are" Insert -- is --

Signed and Sealed this
Twenty-ninth Day of May, 2012

David J. Kappos

David J. Kappos
*Director of the United States Patent and Trademark Office*